US008358223B2

(12) United States Patent
Read et al.

(10) Patent No.: US 8,358,223 B2
(45) Date of Patent: Jan. 22, 2013

(54) MAN OVERBOARD SELF RESCUE DEVICE

(76) Inventors: James B. Read, Inverness, CA (US); Abbie Ann Read, Inverness, CA (US)

( * ) Notice: Subject to any disclaimer, the term of this patent is extended or adjusted under 35 U.S.C. 154(b) by 256 days.

(21) Appl. No.: 12/806,553

(22) Filed: Aug. 14, 2010

(65) Prior Publication Data

US 2012/0038494 A1 Feb. 16, 2012

(51) Int. Cl.
*G08B 23/00* (2006.01)

(52) U.S. Cl. ..... 340/984; 340/987; 340/644; 340/687; 114/199; 114/323; 440/1; 440/84

(58) Field of Classification Search ..... 340/984, 340/987, 644, 687; 114/55.5
See application file for complete search history.

(56) References Cited

U.S. PATENT DOCUMENTS 4,305,143 A * 12/1981 Simms et al. ..... 367/134
4,702,715 A * 10/1987 Winick ..... 441/80
4,714,914 A * 12/1987 Boe ..... 340/573.1
4,891,994 A * 1/1990 Barba ..... 74/2
4,909,171 A 3/1990 Powers
5,006,831 A 4/1991 Solminihac
5,192,238 A 3/1993 Brown
5,408,238 A * 4/1995 Smith ..... 342/357.55
5,748,080 A 5/1998 Clay
5,779,511 A 7/1998 Davidson
5,838,227 A * 11/1998 Murray ..... 340/539.21
6,093,070 A 7/2000 Mannes
6,222,484 B1 * 4/2001 Seiple et al. ..... 342/357.55
7,201,619 B1 * 4/2007 Viggiano et al. ..... 440/1
7,238,074 B1 7/2007 Berndt
7,497,181 B2 * 3/2009 Viggiano et al. ..... 114/102.1
7,553,205 B2 * 6/2009 LoSchiavo et al. ..... 440/1
7,642,919 B2 * 1/2010 Leal et al. ..... 340/573.1

* cited by examiner

*Primary Examiner* — Daniel Wu
*Assistant Examiner* — Son M Tang

(57) ABSTRACT

The vessel control device disclosed herein comprises a channel-mounted, spring-loaded eyebolt that trails a floating line. It also embodies a latch mechanism, a cable release device and an electrical switch.
By the action of grabbing the line the man overboard victim (MOB) can stop the vessel by himself; then use the line to reboard.

1 Claim, 1 Drawing Sheet

MAN OVERBOARD SELF RESCUE DEVICE

FIELD OF SEARCH

441/80

REFERENCES CITED

U.S. Patent Documents:

| | | | |
|---|---|---|---|
| 4,909,171 | Mar. 20, 1990 | Powers | 441/80 |
| 5,006,831 | Apr. 9, 1991 | Solminihac | 441/80 |
| 5,192,238 | Mar. 9, 1993 | Brown | 441/80 |
| 5,748,080 | May 5, 1998 | Clay | 441/80 |
| 5,779,511 | Jul. 14, 1999 | Davidson | 441/80 |
| 6,093,070 | Jul. 25, 2000 | Mannes | 441/80 |
| 7,238,074 | Jul. 3, 2007 | Berndt | 441/80 |

BACKGROUND OF THE INVENTION

1. Field of the Invention

This invention is a device which will enable a man overboard victim to rescue himself. A tug on the trailing floating line will stop the vessel. The line is then used to aid him in reboarding his vessel.

2. State of Prior Art

U.S. Pat. No. 4,909,171 requires a sailor to be continuously attached to a line terminating at the bow. While it is a common safety practice to wear a tethered harness attached to the boat, a long line to the bow would seriously impede his normal activities. This could result in pulling the pin with a trip or fall. While the device will not stop the boat, the claim is to keep it near the victim. There is no provision for reboarding the vessel.

U.S. Pat. No. 5,006,831 requires a man to wear an acoustic signal generator. Additional crew are required to locate and rescue him.

U.S. Pat. No. 5,192,238 describes a device activated by a trailing line that by use of a sea anchor, harness, line and pulley will bring the victim back to a moving vessel. This device will not stop a moving vessel, and it would be very difficult to attach the harness while it is being pulled through the water. This method is bulky and expensive and could injure the victim by smashing him into the transom.

U.S. Pat. No. 5,748,080 describes a light and radio signaling device to be used by a person in the water. This won't stop the vessel and requires additional crew.

U.S. Pat. No. 5,779,511 describes a sheet-like lifting harness for bringing a victim back aboard. This requires additional crew.

U.S. Pat. No. 6,093,070 describes a large lifting crane for victim retrieval. This also requires additional crew.

U.S. Pat. No. 7,238,074 describes a method of retrieving an object in the water. This also requires additional crew.

None of the above mentioned devices will both stop a vessel and provide a means to reboard it. Most require additional crew

OBJECTIVES

It is an object of this invention to allow a Man Overboard Victim (MOB) to shut down his engine.

It is also an object of this invention to allow the MOB to move the rudder fully to one side.

It is also an object of this invention to stop the boat dead in the water.

It is also an object of this invention to sound an alarm to alert any additional crew members who are on board.

It is also an object of this invention to provide the MOB with a floating line attached to the vessel.

It is also an object of this invention that the attached floating line will provide a means for the MOB to reboard the vessel.

These and other objectives as described hereinafter are capable of being met by the device of this invention.

STATEMENT OF THE INVENTION

In accordance with the present invention it has been found that the above objectives are fully met by operation of the device of this invention.

This device is comprised of a spring-loaded eye bolt, an electrical switch and a cable release pin (part of the eye bolt). All are housed inside a structural aluminum channel section which mounts on the stern of the vessel. In addition, a floating line is attached to the eye bolt.

When the MOB grabs the moving line with a jerk pull of approximately 75 pounds the eye bolt will compress the spring against the channel, withdraw from its retaining hole and latch. The latch is accomplished due to the misalignment of the compressed eye bolt which is unable to re-enter its retaining hole. The misalignment has two causes: the first being the inside taper of the channel section, item 1. The second is caused by the upward force of the contact spring, item 6. When the device is latched any attached cable is released and the electrical switch is closed.

Figure 1:
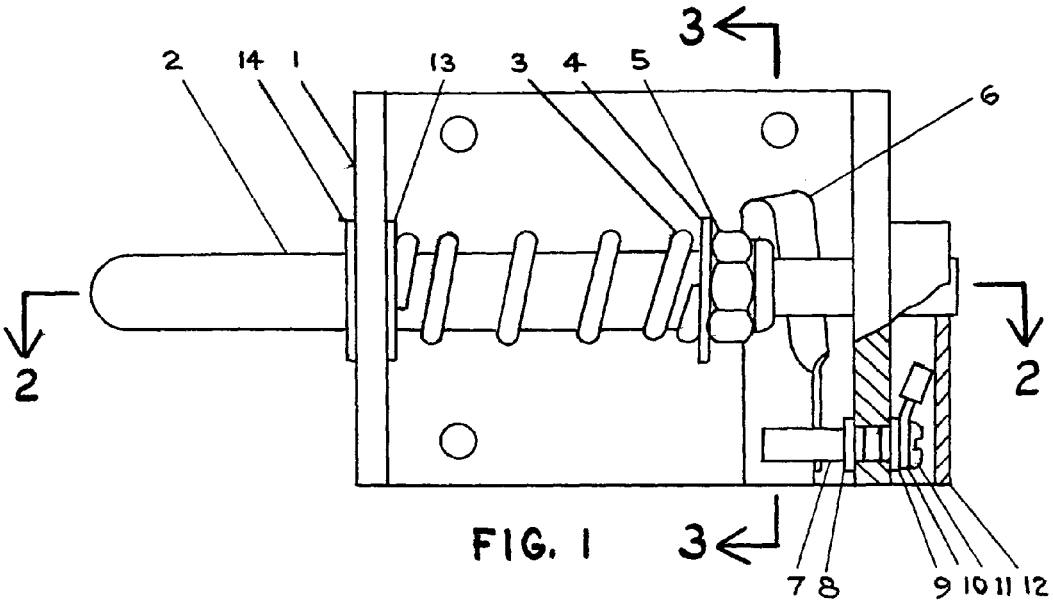
FIG. 1 is a plan view of the switch device.

The device of this invention may be further described by reference to the drawings in which:

FIG. 1 is a plan view of the device showing virtually all parts in the relaxed, non-compressed position. The eye bolt, item 2, which is also the cable retention pin, is shown protruding completely through the cable retention channel, item 12. The contact spring, item 6, is held depressed by 2 and away from the contact pin, item 7. Item 7 is isolated from the channel section, item 1, by insulating shoulder washers, items 8 and 9. A retaining screw, item 11, connects the crimp terminal, item 10, to 7 and binds them together. Flat washers, items 13 and 14, and the lock nut, item 5, provide tension adjustment for the compression spring, item 3.

Figure 2:
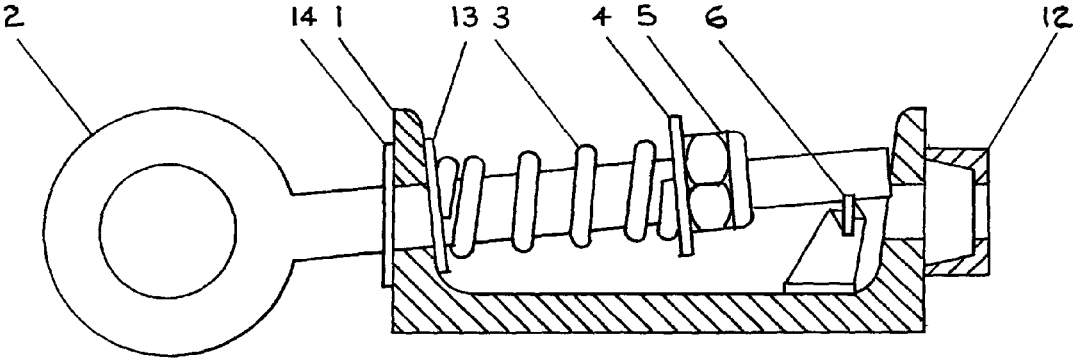
FIG. 2 is a side view section of the switch device.

FIG. 2 is a section view taken at line 2-2 of FIG. 1. This view best describes the structural channel section, item 1, to which all other parts are mounted. In this view 3 is fully compressed between 13 and 1 at one end, and 5 and flat washer, item 4, at the other end. The eye bolt, item 2, under maximum pressure, having been pulled out of 12 and out through the retaining hole of 1 is stuck against the top of that hole and is now "latched". The contact spring 6 is shown in the relaxed, "closed contact" position, no longer depressed open by 2.

The eye bolt/cable retention pin 2 is shown pulled out of 12, thus releasing the cable end. With the exception of the two channel sections and the nickel-plated brass contact pin 7, all other metallic parts are stainless steel.

Figure 3:
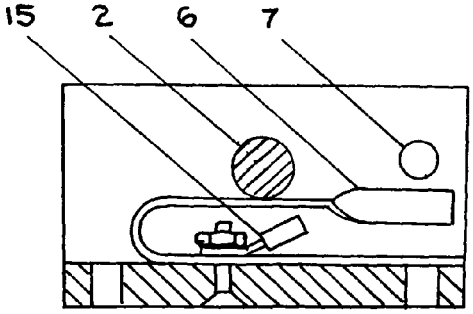
FIG. 3 is a side view of an electrical switch.

FIG. 3 is a section view taken at line 3-3 of FIG. 1. This shows the contact spring 6 being held away from 7 by 2. This also displays the attachment of the ground crimp terminal, item 15.

Figure 4:
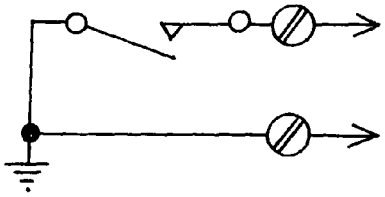
FIG. 4 is a diagram showing electrical switch circuitry.

FIG. 4 is an electrical schematic representation of the switch in FIG. 3.

While certain features of this invention have been described in detail with respect to various embodiments thereof, it will of course be apparent that other modifications can be made within the spirit and scope of this invention, and it is not intended to limit the invention to the exact details insofar as they are defined in the following claims

The invention claimed is:

1. A system for a man overboard self-activated electrical switch device, comprising:

a towed line pull cable installed on a vessel;

an electrical switch device, the device comprising:

a structural channel section arranged to house an electrical switch and a release mechanism structure;

said structural channel section having a front wall and a back wall, each of said walls have a hole, inside surface of each front and back walls are being tapered, the back wall further includes a retention channel connected at exterior of said back wall;

said release mechanism structure includes a spring-loaded eyebolt release pin which connected to the pull cable at one end and protruding through the holes of the structure channel section at other end, a portion of the spring-loaded eyebolt release pin is positioned within the structural channel section with a compress spring secured on the spring-loaded eyebolt release pin, the compress spring secured by a first flat washer and a lock nut at one end of the release pin, and against the front wall held by a second flat washer at other end of the release pin;

said electrical switch includes a contact spring arranged within the structural channel section and mounted to be held against the spring-loaded eyebolt release pin at the back wall;

the electrical switch is held in open contact position when said release pin is protruded completely through said front wall, said back wall and the retention channel, and the electrical switch is closed contact position when release pin is freely withdraw from the retention channel and the back wall, the contact spring no longer depressed by the release pin;

a combination of said release mechanism and said electrical switch configured to activate the electrical switch device;

said electrical switch is activated in response to a man overboard event, when said towed line pull cable is pulled, the release mechanism structure withdraws the spring-loaded eyebolt release pin from the back wall, causes the electrical switch device to be in a closed position; and in response to the activation of the electrical switch device activates an audible alarm and at least one of shut-down an engine and move a rudder fully to one side.

* * * * *